United States Patent [19]

Hess

[11] Patent Number: 5,014,776

[45] Date of Patent: May 14, 1991

[54] HEAT EMITTING UNIT IN FORM OF A HEATER OR COOLER

[76] Inventor: Joachim Hess, Schroeplerstrasse 35, D-8070 Ingolstadt, Fed. Rep. of Germany

[21] Appl. No.: 327,124

[22] Filed: Mar. 22, 1989

[30] Foreign Application Priority Data

Apr. 27, 1988 [DE] Fed. Rep. of Germany ..... 3814145

[51] Int. Cl.[5] ..... F28F 7/00; B23P 11/00

[52] U.S. Cl. ..... 165/185; 165/76; 29/890.03; 29/509

[58] Field of Search ..... 165/76, 185; 29/157.3 R, 157.3 A, 509, 513, 514, 890.03

[56] References Cited

U.S. PATENT DOCUMENTS

| | | | |
|---|---|---|---|
| 925,028 | 6/1909 | Richards | 29/509 X |
| 1,680,369 | 8/1928 | Dugan | 29/514 |
| 3,068,160 | 12/1962 | Erwin | 29/509 X |
| 3,216,496 | 11/1965 | Katz | 165/185 |

FOREIGN PATENT DOCUMENTS

| | | | |
|---|---|---|---|
| 908582 | 4/1954 | Fed. Rep. of Germany | 29/514 |
| 1100057 | 2/1961 | Fed. Rep. of Germany | 165/185 |
| 60-257157 | 12/1985 | Japan | 164/185 |
| 798613 | 7/1958 | United Kingdom | 29/509 |

*Primary Examiner*—Allen J. Flanigan
*Attorney, Agent, or Firm*—Cort Flint

[57] ABSTRACT

The instant invention relates to a heat emitting unit in form of a heating or cooling body having a main body (2) and a number of parallel, flat ribs (3, 4) attached to at least one side of the main body and projecting from said main body. According to the invention a number of parallel channels (16, 17) with an undercut profile and separated by intermediary ridges (18) are provided for the attachment of the ribs (3, 4). The ribs (3, 4) are inserted from the side into the channels by matching foot profiles and are pressed into place through deformation of the intermediary ridges. This results in advantages in manufacture, in heat emission and in the sizing as well as in the applicability of the heat emitting unit.

21 Claims, 2 Drawing Sheets

HEAT EMITTING UNIT IN FORM OF A HEATER OR COOLER

BACKGROUND OF THE INVENTION

The instant invention relates to a heat emitting unit in the form of a heater or cooler, and in particular to a heating unit to heat valve blocks and measuring instruments.

In industrial plants, often a number of measuring instruments connected via valve units to pipe lines are used. Pressure or flow measuring points for fluid media in the known arrangement of measuring transducers and upstream valve blocks, for example, are called pressure or flow measuring points. Out of doors these installations are normally mounted in protective instrument cabinets and the inside of such an instrument cabinet or the built-in instruments themselves are heated directly by thermostatically controlled heaters.

In general such a heater is expected to be highly efficient, to require little space, to be adaptable to different conditions, and to adjust precisely to a preset temperature while safety regulations, e.g. with respect to protection against contact and possibly explosion protection, are observed. Installation and possible retrofitting should be simple and assembly should be easy.

A known heating block (DE OS 36 33 682) consists of a main body and of a number of parallel, flat ribs projecting from the main body and attached to at least one side of the main body. The main body contains the heating element and the thermostatic setting. The main body is heated by the heating element and ribs with large surfaces and little thickness are provided at short intervals in order to offer as large a heat-radiating surface as possible. It has been found that the design or the attachment of such a rib system poses problems.

The possibility exists to produce the main body together with the ribs as a unit, in the form of a cast part. However, casting technology only permits to obtain relatively thick ribs with relatively great spaces between them, so that the requirements for the unit to occupy little space, to use a small amount of material, and to weigh little are not met satisfactorily.

In the DE OS 36 33 682 a completely different structure was therefore described, so that the prefabricated, punched-out sheet-metal ribs are incorporated into a main body in the casting process. In this process the sheet-metal ribs can project from the main body laterally, advantageously on both sides so that said main body can be kept relatively small. It was found, however, that such a process requires much effort and is expensive, due in particular to the time-consuming insertion of the sheet-metal ribs into the hot casting die.

It is furthermore well known that cooling bodies can be made of aluminum by means of extruders. In this process an extrusion profile with rib-shaped projections is drawn off. This profile is then cut off in disk form in the length desired for the cooling body. This process is not practically applicable in the instant case where long, narrow ribs are needed. It is known that technical difficulties arise with extruders when narrow ribs are to project far from a main profile billet because the flow of material at those points is hindered much more during draw-off than in the main profile billet. Furthermore, difficulties arise in the storage of such profiles to cool them because narrow ribs projecting far then risk becoming deformed and bent.

Furthermore, the basic configuration of the cooling body is determined in this process in such a manner that the ribs cannot extend beyond the main body laterally in the direction of the ribs because of the disk-shaped separation from the extruded profile billet. As is explained below, this restricts the possibilities of application considerably.

The production of a main body with shorter ribs by extrusion in order to obtain long ribs is widely known, and in this process the above-mentioned technical problems in manufacture do not arise. Furthermore, a second body, also technically well obtainable provides shorter ribs at proper intervals, is produced by extrusion. These two bodies are joined together at their free rib ends and are placed on top of each other in comb fashion so that cooling ribs are obtained in lengths that are equal to the sum of the lengths of two ribs placed on top of each other. However this necessarily results in closed cooling channels which are open only in one direction of the ribs, reducing the application possibilities of such devices.

It is the object of the instant invention to create a heat emitting unit in the form of a heating or cooling body in which the relatively long and numerous ribs can be realized technically in a satisfactory manner and can be produced inexpensively, whereby the possibility of allowing the ribs to project laterally beyond the main body should in particular be given so as to ensure universal applicability.

SUMMARY OF THE INVENTION

The above object is attained according to the present invention by providing a number of parallel channels, each separated from the other by an intermediary ridge on at least one side of the main body. The channels have such a cross-section profile such that surface areas are present on at least one long side of the channels which extend at an inward slant in relation to the surface of the main body. The channels widen towards the inside and so that an undercut is created. Furthermore, ribs with foot profiles attached to one long side are provided. The foot profiles have a cross-sectional profile matching that of the channels, but slightly smaller. The ribs are pushed into the grooves laterally into the insertion openings. When assembled, the ribs and the main body are thereby already held together.

The attachment of the ribs or of their foot profiles in the channels is effected by exerting pressure on the intermediary ridges (with the ribs being aligned), causing said ridges to be plastically deformed so that the foot profiles are pressed into place and are attached. The pressure can be exerted by a tool with comb-shaped adjoining pressure elements, for example, which are introduced between the aligned ribs and which are brought to bear on the intermediary ridges.

Because of the flat surfaces of the channels extending at an angle or their undercuts, the foot profiles are not only pressed together from the side to a certain extent, but are moved into the channels towards the bottom of the channels where they are firmly pushed against said bottom. This ensures on the one hand a very strong mechanical seating. On the other hand, this is also particularly advantageous from the point of view of thermal conduction because the profile configuration and this type of insertion by pressure causes the contact surfaces to be in intimate and strong contact without any gaps, so that good thermal conduction especially directly from the inside of the main body and over the bottom of each channel is ensured.

In one embodiment of the invention the ribs can be provided on their surfaces with known structures for surface expansion. To adapt to geometric conditions during assembly, e.g. pipelines extending in the vicinity of the rib body, it is possible to omit individual ribs or groups of adjoining ribs or to omit ribs in some of the channels. Another possibility consists in using shorter ribs with the same foot profile. The width of the ribs preferably extend beyond the main body in direction of the channels. In this way the main body can be kept relatively small and light, with savings in materials. A further and especially important advantage is obtained through the fact that the heat emitting unit can be used in this case in a "lying down" and in a "standing" position. The lying down position is assumed when the long sides of the ribs are horizontal and their surfaces are vertical or when the channels extend vertically along the main body. Heated or cooled air can thus flow between the ribs.

The standing position is assumed when the surfaces of the ribs stand vertically and when the ribs also stand vertically in their longitudinal direction or when the channels on the main body lie horizontally. In this position it is necessary for proper heat transfer and suitable flow conditions that the width of the ribs extend relatively far beyond the main body. A structure according to claim 4, in which ribs are attached at two opposite sides of the main body is useful in this case. An appropriate ratio between the width of the main body and the width of the ribs is approximately 1 : 2, the rib surfaces being approximately square in their outline.

Since the ribs should be relatively thin, the foot profile of the ribs in cross-section will normally show a cambered thickening of the material. This is an advantage not only from the point of view of strength, but leads to favorable, improved thermal conduction at the foot of the ribs, especially when the width of the ribs extends beyond the main body. This improves the overall heat emission characteristics of the ribs.

Furthermore this thickening in the material improves the flow conditions for good heat emission when the heat emitting unit is operated in its standing position described above.

Improved heat emission is achieved when using the heat emitting unit in its standing position where the flow conditions are altered by attaching the ribs on opposite sides in a staggered manner.

It can be seen in general that the universal character of application in a lying-down and in a standing position is only possible if the ribs project freely and are not connected at their free ends, as is in part the case in the existing art, so that no closed cooling channels are created at these points.

The main body can contain a heating element in a known manner as well as a thermostat if necessary. Furthermore bores and other elements for the mechanical attachment of the heat transfer unit are preferably provided. Also, contact surfaces for application against an object to be cooled or heated can be provided.

Special advantages are obtained if the main body and/or the ribs are extruded billets, made of aluminum for example. The main body can be drawn off directly together with the incorporated channels and can be cut off at the required width. An extruded billet corresponding to the ribs with the foot profile can also be drawn off and can then be cut off in the normally greater width required for the ribs. This does not cause any difficulties in manufacture.

Different profiles for the channels and foot profiles of the ribs are possible which meet different requirements. Swallowtail profiles with straight surface areas, of different configurations may be used. Thereby a secure seating and good parallel alignment of the ribs with respect to each other is achieved as soon as the lateral insertion of the ribs into the channels is completed. In a circular design of the profile cross-section, the ribs are capable of some oscillation in profile, and would not be aligned during assembly, before being pressed into place. In such an embodiment additional contact edges are provided in the area of the foot profiles, holding the ribs in their aligned position. The round profiles will have a very good, full pressure contact when pressed into place. Combined surfaces in the form of arcs-of-circle with straight areas in the profile cross-section may be provided to maintain flat adhering contact surfaces together with a suitable geometry for the pressing-in process. The rounded-off areas at the foot profiles furthermore facilitate the introduction into the channels and reduce the risk of injury from projecting edges.

In order to facilitate the plastic deformation in the area of the intermediary ridges, a keyway can be provided in the middle of each intermediary ridge and parallel to the profile channels. The keyways may have a certain wedge angle, e.g. 45°. Their depth should be shallower than the depth of the profile channels, preferably one half the depth. To press the ribs into place and to obtain the plastic deformation in the area of the intermediary ridges which is required for this, wedging tools are inserted into the keyways to open them to a greater angle.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
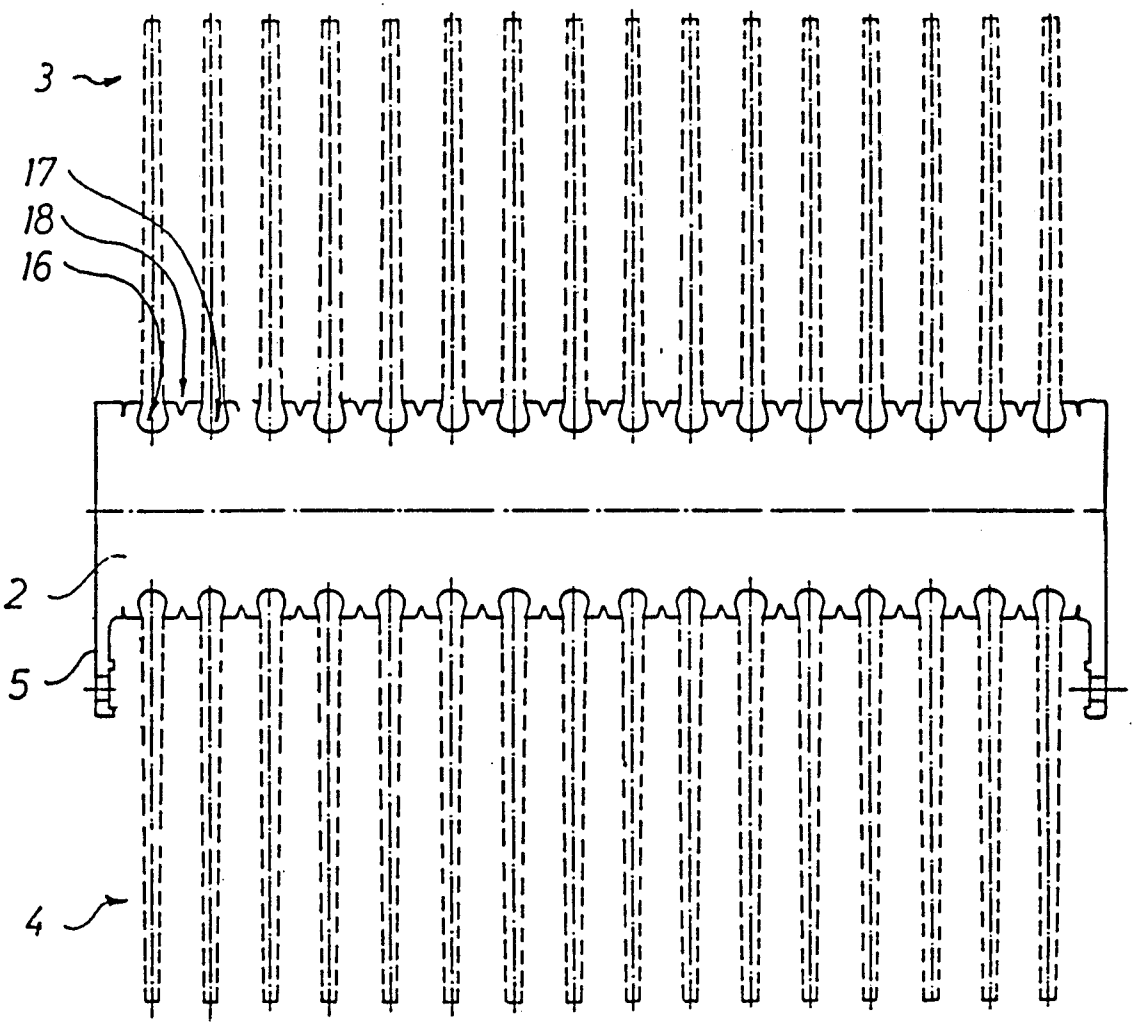
FIG. 2 is a side elevation or top plan view of the heat emitting unit of FIG. 1.
Figure 1:
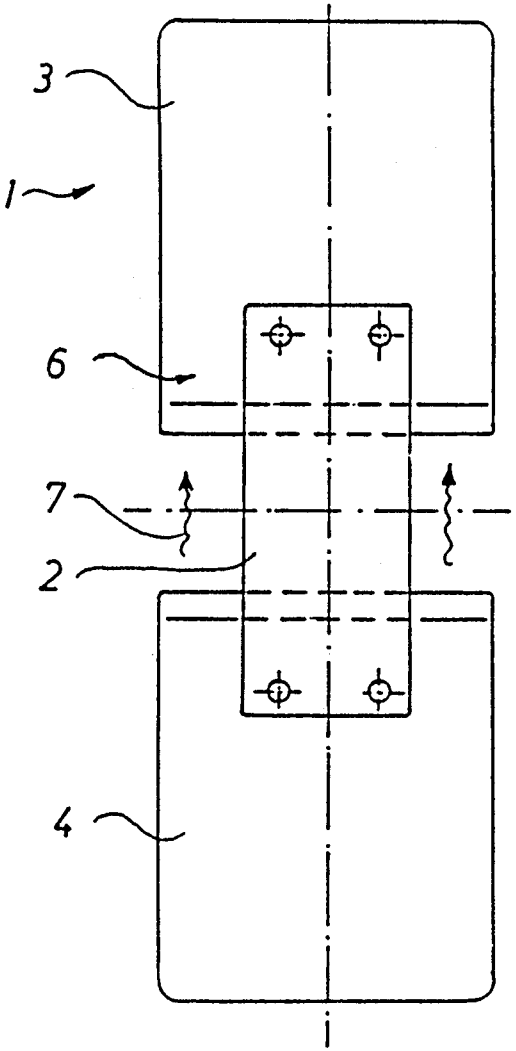
FIG. 1 is an end elevation of a heat emitting unit in the longitudinal direction constructed in accordance with the invention.
Figure 3:
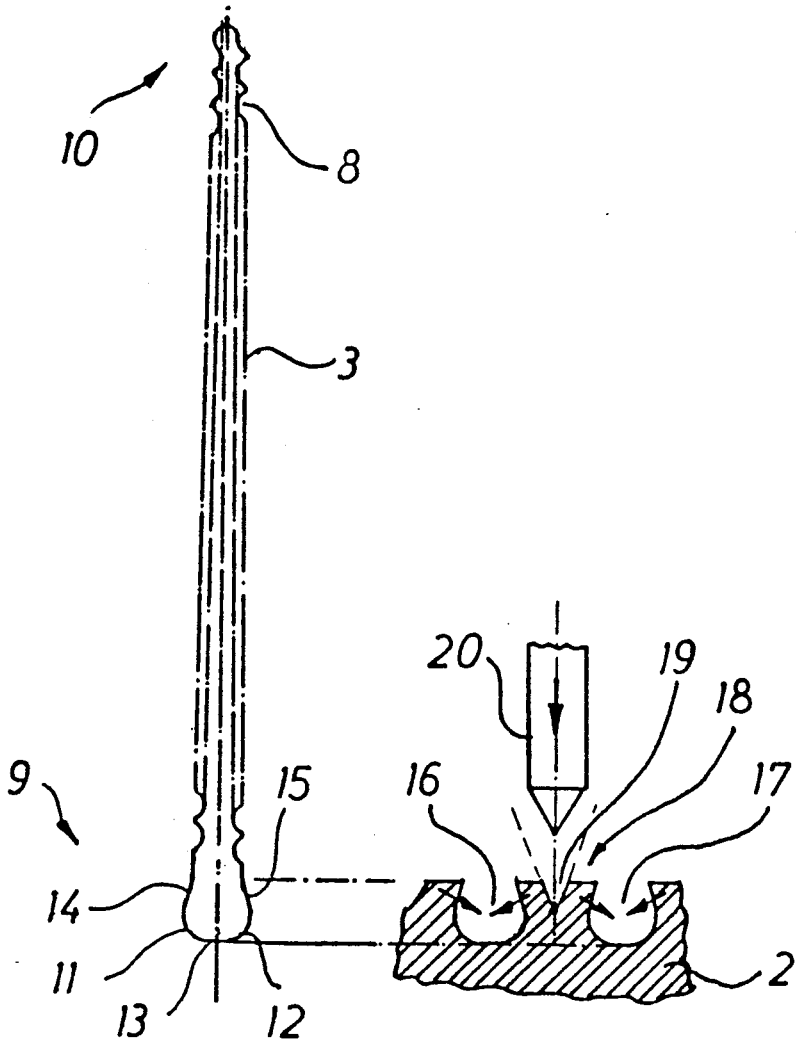
FIG. 3 is a longitudinal view of an individual rib with foot profile and a partial section of a main body with corresponding channels according to the invention.

Referring now in more detail to the drawings, FIGS. 1 and 2 illustrate a heat emitting unit 1 consisting of a long main body 2 with ribs 3 and 4 attached at opposite sides. For purposes of clarity, ribs 3 and 4 are shown in dotted lines. Heating and regulating elements (not shown) may be contained in main body 2. Ribs 3, 4 serve to expand the heat emitting surface. Flanges 5 are integrally attached at one side of the main body 2, containing bores for attachment, for example within an instrument cabinet. Main body 2 is an extruded aluminum part which is drawn off from the extruder, in the form shown in FIG. 2, in a direction perpendicular to the plane of the drawing. The one-sided attachment of the flange 5 has the special advantage that the still hot and plastic billet lies flat on its support as it cools and thus does not become distorted.

As can best be seen in FIG. 1, ribs 3, 4 are approximately twice as wide as the main body 2 and project transversely beyond it with their lateral areas 6. The heat emitting unit 1 can therefore be used in a lying-down position and in an upright, standing position. In the lying-down position, FIG. 2 would be the top plan view, and in the upright standing position FIG. 2 would be a side view. As can be recognized in FIG. 1 that in the standing position the main body 2 has only little influence upon the flow conditions (arrows 7) for favorable heat transfer because of the laterally projecting ribs.

The design of ribs 3, 4 is explained in greater detail through FIGS. 3 to 6, as is their attachment to the main body 2. Rib 3 is a long, flat part of little thickness which is made of aluminum and produced by extrusion. The lateral surfaces are provided with the structures 8 in order to achieve an enlargement of the surfaces. In cross-section each rib 3 extends somewhat conically, starting at a thicker foot profile 9 and going to the free outer edge 10. The outer edge 10 and the foot profile 9 are rounded off. As can best be seen in FIG. 3, foot profile 9 consists of two lateral surfaces 11, 12 in the form of arcs of a circle which are connected by a straight bottom surface 13. The lateral surfaces 11, 12 are followed by generally straight surfaces 14, 15 extending upward and at an angle with respect to each other. Channels 16, 17, extending parallel to each other, are provided in the same number as the ribs 3, 4 in main body 2. Their cross-section matches the cross-section of foot profiles 9 and are slightly larger.

During assembly ribs 3, 4 are inserted into channels 16, 17 from the side until they are in a position shown in FIG. 1. Because of an undercut configuration of the profile of channels 16, 17, ribs 3, 4 can be pushed in only from the side and are secured against falling out in all the other directions. The arrangement holds together as soon as this assembly step is completed. Due to the design of the profile, in particular surfaces 14, 15 an alignment of ribs 3, 4 perpendicular to the surface of main body 2 is achieved. Ribs 3, 4 are very much parallel to each other. Foot profile 9 of the ribs and channels 16, 17 can be sized exactly and produced precisely through extrusion so that the alignment of ribs 3, 4 is accordingly precise when they have been inserted.

Intermediary ridges 18 are provided between adjoining channels 16, 17. According to FIG. 3 a keyway 19 is provided in the center, extending parallel to channels 16, 17. Keyway 19 has a wedge angle of approximately 45° and is approximately half as deep as channels 16, 17. In order to attach ribs 3, 4 a chisel 20 is simultaneously pressed into each keyway 19. The angle of chisel 20 at the point is slightly greater than the wedge angle of the keyway 19. This causes the lateral areas of the channels 16, 17 to be forced downward at an angle toward each other as indicated by the arrows in the drawing. This results in retention of foot profile 9 following plastic deformation. It can be seen that foot profiles 9, in addition to the lateral components, are forced down in the direction of the bottom of channels 16, 17 because of the special profile design. They are pressed into place, and adhere well and evenly and with good contact upon being pressed into place, without any clearance. This is essential for secure seating and good heat transfer from main body 2 to ribs 3, 4.

Figure 4:
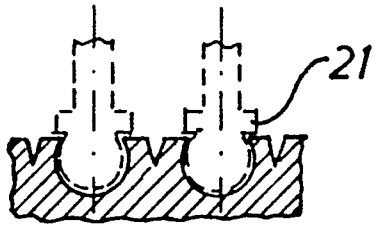
FIG. 4 is a second embodiment of a profile design according to the invention.
Figure 5:
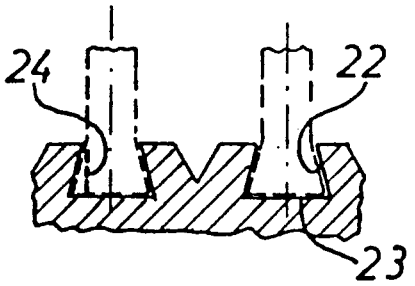
FIG. 5 is a third embodiment of a channel design according to the invention.

FIG. 4 shows a second embodiment of a foot profile 9 and of a channel cross section. Starting at an upper longitudinal opening, the profile cross-section widens in the form of a circle. In order to achieve good alignment of the ribs after insertion into the channels, contact edges 21 are incorporated in the form of ridges extending slightly beyond the channel opening and supporting the ribs at that location against lateral pivoting. FIG. 5 shows a third embodiment of a foot profile 9 with the ridge in form of a swallowtail, with lateral surfaces 22 extending at an angle, and with a straight bottom surface 23. It would also be possible to provide only one slanted lateral surface 22 and to design the other lateral surface as extending perpendicularly to the inside, as indicated by the broken line 24. In the second and third embodiment according to FIGS. 4 and 5, the wedging tool 20 already shown is used with a series of parallel chisels, whereby the keyways in the intermediary ridges 18 are expanded and subjected to plastic deformation.

Figure 6:
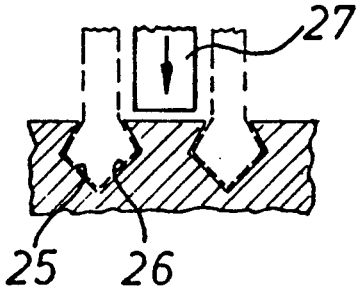
FIG. 6 is a fourth embodiment of a channel design according to the invention.

An additional, fourth embodiment of a foot profile 9 and of a channel cross-section are shown in FIG. 6. The swallowtail profile of FIG. 5 is here expanded downward by additional straight slanted surfaces 25, 26, so that an overall approximately square cross-section is obtained for the foot profile 9.

From the types of the different foot profiles 9 shown it can be seen in general that the main feature is the undercutting in the channels, causing the plastic deformation of the pressure components in a desired manner when the ribs are pressed into place by a downward pressure on the channel sides. FIG. 6 shows an embodiment 6 representing an additional variant for the pressing-in process. Here there are no keyways in the intermediate ridges 18. The ribs are pressed into place by means of a tool with comb-like adjoining hammer elements 27 which are applied evenly on the surfaces of the intermediary ridges. Here too, plastic deformation in the area of the intermediary ridges is produced under pressure, causing the ribs to be attached.

FIGS. 3 to 6 show that the foot profile 9 of the ribs 3, 4 is in general a thickening of material with correspondingly good thermal conduction. Thereby good thermal conduction into the lateral areas 6 is maintained in the embodiment according to FIG. 1. In conclusion it should be noted that the instant invention offers a heat emitting unit which can be used universally and functions well, is technically simple and inexpensive to produce.

While a preferred embodiment of the invention has been described using specific terms, such description is for illustrative purposes only, and it is to be understood that changes and variations may be made without departing from the spirit or scope of the following claims.

What is claimed is:

1. A heat emitting unit having with a main body and a number of parallel generally flat ribs attached to at least one side of said main body protruding from said main body, comprising:

a plurality of channels extending generally parallel in said main body;

a plurality of intermediary ridges separating said channels;

said channels having a profile defined by generally flat surfaces on at least one side of each channel which extend at an angle relative to an outer surface of said main body so that said channels become wider towards an interior of said channels and create an undercut;

said channels having an open top which permits said ribs to protrude outwardly from said channels, and said channels having an open end which facilitates insertion of said ribs from said open end;

a foot profile formed on the ends of said ribs which generally corresponds to a cross-sectional profile of said channels, said foot profiles having a slightly smaller cross-sectional profile than said channels;

said foot profiles being insertable through said end opening so that said ribs and main body are assembled together; and said ribs and main body being assembled together through pressure on said intermediary ridges which causes a deformation so that said foot profiles are pressed into place within said channels in said interior of said main body creating strong adherence and thermal conduction contact.

2. The apparatus of claim 1 wherein said foot profiles include flat surfaces which correspond generally to said flat surfaces of said channels which are pressed together and facilitate increased thermal contact.

3. The apparatus of claim 1 wherein said main body has a width defined by opposing sides in which said open ends of said channels are formed, and said ribs have a lateral width projecting beyond said width of said main body on at least one of said opposing sides thereof.

4. The apparatus of claim 1 wherein said foot profiles constitute a cross-section having a cambered thickening of material and said ribs have a relatively small thickness.

5. The apparatus of claim 1 wherein said ribs extend from said channels on opposing sides of said main body.

6. The apparatus of claim 5 wherein said channels in said main bodies and said ribs assembled in said channels are arranged generally at identical intervals.

7. The apparatus of claim 1 wherein said profile cross-section of said channels and of said foot profiles is generally in a form of a swallowtail having at least one lateral surface extending at an angle and a bottom surface extending parallel to said surface of said main body.

8. The apparatus of claim 7 wherein said swallowtail is provided with inclined surfaces which extend toward an interior of said main body.

9. The apparatus of claim 1 wherein said cross-sectional profiles of said channels and foot profiles are generally circular and said foot profiles extend slightly beyond contact edges of said channel opening.

10. The apparatus of claim 1 wherein said cross-sectional profiles of said channels and foot profiles include two lateral surfaces having an arcuate form which are interconnected by a generally straight surface on the underside of said foot profile, and generally straight surfaces extending at an inclination of said lateral arcuate surfaces towards said open top of said channels.

11. The apparatus of claim 1 including a keyway formed in an outer surface of said intermediary ridges extending generally parallel to said channels, said keyway having a depth which is shallower than the depth of said channels.

12. Heat transfer apparatus of the type having a main body and a plurality of parallel heat transfer ribs carried by said main body extending generally outwardly from said main body;

a plurality of open top channels formed in said main body having at least one open end in said main body;

said ribs including foot profiles which are slidably received from said open end through said channels in an axial direction;

at least one undercut formed by a cross-section which underlies at least in part said undercut;

said ribs and main body being assembled together by pressure on said undercut toward an interior of said main body which urges surfaces of said foot profiles and channels together in a fixed heat exchange contact;

and wherein said main body has a width defined by opposing sides in which said at least one open end of said channels is formed, and said ribs have a lateral width projecting beyond said width of said main body on at least one of said opposing sides thereof.

13. The apparatus of claim 12 wherein said channels include upper, outer edges and said undercuts are formed by interior edges underneath said outer edges, and said foot profiles having a correspondingly shaped surface for lying underneath said undercut.

14. The apparatus of claim 13 wherein said foot profile includes a generally flat surface for contacting said bottom surface of said channel when press fitted together.

15. The apparatus of claim 1 including an intermediate ridge formed between adjacent channels, and said ridges being deformable to press fit said ribs and said main body together.

16. A method of assembling a main body and ribs in a heat transfer unit comprising:

providing a main body having a plurality of generally parallel channels extending through a surface of said main body, said channels having an open top and opposed open ends;

providing fins with foot profiles on a base of said ribs which may be slidably inserted into said channels from at least one of said open ends only;

providing intermediary ridges between said channels which define undercuts within said channels; and press fitting said main body and ribs together by deforming said intermediary ridges inwardly to cause corresponding surfaces of said channels and foot profiles to be fitted together in fixed heat exchange contact.

17. The method of claim 14 including providing said undercuts in the form of flat surfaces.

18. The method of claim 16 including assembling said main body and ribs with said ribs projecting laterally beyond at least one side of said main body.

19. The method of claim 18 including projecting said ribs laterally beyond both sides of said main body.

20. The method of claim 16 comprisiing providing said main body and ribs in the form of extruded parts.

21. The apparatus of claim 3 wherein said ribs project laterally beyond both of said opposing sides of said main body.

* * * * *